US007225502B2

(12) United States Patent
Shenouda

(10) Patent No.: US 7,225,502 B2
(45) Date of Patent: Jun. 5, 2007

(54) SYSTEM FOR REMOVAL OF STAINS

(75) Inventor: Ben Shenouda, Phoenix, AZ (US)

(73) Assignee: The Dial Corporation, Scottsdale, AZ (US)

( * ) Notice: Subject to any disclaimer, the term of this patent is extended or adjusted under 35 U.S.C. 154(b) by 593 days.

(21) Appl. No.: 10/692,163

(22) Filed: Oct. 23, 2003

(65) Prior Publication Data

US 2005/0086761 A1 Apr. 28, 2005

(51) Int. Cl.
*A47L 5/16* (2006.01)

(52) U.S. Cl. ..... 15/320; 15/394; 15/344; 100/234

(58) Field of Classification Search ..... 15/320, 15/394, 409, 344; 68/5 A, 212, 213, 235 R, 68/240; 100/234, 243
See application file for complete search history.

(56) References Cited

U.S. PATENT DOCUMENTS

| | | | | | |
|---|---|---|---|---|---|
| 2,822,680 | A | * | 2/1958 | Lamping | 68/213 |
| 2,887,948 | A | * | 5/1959 | Irving et al. | 100/234 |
| 4,083,077 | A | | 4/1978 | Knight et al. | 15/321 |
| 4,120,180 | A | | 10/1978 | Jedora | 68/20 |
| 4,159,554 | A | | 7/1979 | Knight et al. | 15/321 |
| 4,166,368 | A | | 9/1979 | Beninca et al. | 68/20 |
| 4,225,991 | A | | 10/1980 | Bolton et al. | 8/151 |
| 4,249,399 | A | | 2/1981 | Bolton et al. | 68/20 |
| 4,279,057 | A | | 7/1981 | Restivo | 15/415.1 |
| 4,373,226 | A | | 2/1983 | Lübnitz | 15/302 |
| 4,534,083 | A | | 8/1985 | Hampson | |
| 4,567,064 | A | | 1/1986 | Wöoste | 427/157 |
| 4,790,155 | A | | 12/1988 | Daniel et al. | 68/205 R |
| 4,805,425 | A | | 2/1989 | Fleissner | 68/20 |
| 4,904,009 | A | * | 2/1990 | Kozlinski | 100/234 |
| 4,974,618 | A | | 12/1990 | Nysted | 134/21 |
| 4,998,317 | A | | 3/1991 | Passien | 15/321 |
| 5,001,806 | A | | 3/1991 | Gurstein | 15/322 |
| 5,074,132 | A | | 12/1991 | Koller | 68/205 R |
| 5,203,044 | A | | 4/1993 | Jung, Jr. | 8/149.1 |
| 5,228,161 | A | | 7/1993 | Scatizzi | 8/151 |
| 5,253,378 | A | | 10/1993 | Jung, Jr. | 8/149.1 |
| 5,255,541 | A | | 10/1993 | Porter et al. | |
| 5,335,591 | A | * | 8/1994 | Pozar | 100/234 |
| 5,402,657 | A | | 4/1995 | Henry, Jr. | 68/5 A |
| 5,493,754 | A | | 2/1996 | Gurstein et al. | 15/321 |
| 5,551,741 | A | * | 9/1996 | LaBoccetta | 100/234 |
| 5,568,739 | A | | 10/1996 | Fleissner | 68/5 D |
| 5,611,868 | A | | 3/1997 | Gurstein et al. | 134/21 |
| 5,720,078 | A | | 2/1998 | Heintz | 15/415.1 |
| 5,765,407 | A | | 6/1998 | Choo et al. | 68/214 |

(Continued)

*Primary Examiner*—Theresa T. Snider
(74) *Attorney, Agent, or Firm*—Snell & Wilmer LLP

(57) ABSTRACT

An apparatus for removing stains from a fabric includes a device configured to draw a stain removal liquid through the fabric. The stain removal liquid may be drawn through the liquid through the use of suction directed by a nozzle. The nozzle may be placed over the fabric, which is placed over a reservoir of stain removal liquid. Thereafter, a pressure is activated and the stain removal liquid is drawn through the fabric, removing the stain. The apparatus may be a hand-held device. The hand-held device comprises two handles and two workpieces. A pressure source is placed in the handle, creating a pressure at a first workpiece. The fabric is placed between the first workpiece and the second workpiece, drawing a stain removal liquid from a reservoir in the second workpiece through the fabric.

8 Claims, 3 Drawing Sheets

U.S. PATENT DOCUMENTS

| | | | | |
|---|---|---|---|---|
| 5,815,869 | A | 10/1998 | Hopkins | 8/158 |
| 5,849,039 | A | 12/1998 | Sadlowski | 8/137 |
| 5,891,197 | A | 4/1999 | Young et al. | 8/137 |
| 5,891,198 | A | 4/1999 | Pearlstein | 8/158 |
| 5,976,194 | A | 11/1999 | Franzen | 8/142 |
| 5,980,582 | A | 11/1999 | Gehrlein et al. | 8/149.1 |
| 6,036,787 | A | 3/2000 | Bennett et al. | 134/21 |
| 6,263,708 | B1 | 7/2001 | Yarmosky | 68/5 A |
| 6,309,425 | B1 | 10/2001 | Murphy | 8/142 |
| 6,324,875 | B1 | 12/2001 | Hoermann | 68/205 R |
| 6,376,444 | B1 | 4/2002 | Hortel et al. | 510/277 |
| 6,391,061 | B1 | 5/2002 | Hortel et al. | 8/137.5 |
| 6,457,335 | B1 | 10/2002 | Fleissner | 68/19.1 |
| 6,482,242 | B2 | 11/2002 | Yarmosky | 8/149.1 |
| 6,513,192 | B1 | 2/2003 | Pearlstein | 15/415.1 |
| 2002/0077266 | A1 | 6/2002 | Gabriel et al. | 510/297 |
| 2002/0185157 | A1 | 12/2002 | Engel et al. | 134/10 |
| 2002/0189025 | A1 | 12/2002 | Hortel et al. | 8/137.5 |
| 2002/0194692 | A1 | 12/2002 | Giddings et al. | 15/320 |
| 2002/0198126 | A1 | 12/2002 | Irvin et al. | 510/305 |
| 2003/0028974 | A1 | 2/2003 | Moe et al. | 8/158 |
| 2005/0166642 | A1* | 8/2005 | Soberg | 68/5 A |

* cited by examiner

SYSTEM FOR REMOVAL OF STAINS

FIELD OF INVENTION

The present invention relates generally to methods for treatment of stains on fabrics.

BACKGROUND OF THE INVENTION

Fabrics often become soiled from regular use. Thus, fabrics need to be periodically cleaned to remove stains and odors. Usually, the fabric is placed in water with detergent and the water/detergent mixture is agitated, typically using a machine. A problem arises in that common laundry detergents may be less than completely effective when removing certain types of stains, such as oily stains, waxy stains, particulate stains, and sebum stains. To facilitate the removal of these stains, pre-treatment or spot-cleaning of the stains is typically used. In this regard, there are a variety of soil and stain removers which are available in a variety of forms, such as sprays, liquids, sticks, and wipes.

A typical use of spot-cleaning involves applying a cleaning composition directly to the stain or soiled area of fabric. Thereafter, the fabric is laundered in a washing machine, by hand, or through the use of some other cleaning method whereby the cleaning composition effects removal of the stain or soil from the fabric article.

Various of the foregoing stain removing compounds and delivery systems have benefits and drawbacks depending on their particular form. For example, liquids and sticks provide targeted application, but generally tend to be messy. Sprays are often convenient and easy to use, but generally tend to treat an area that is larger than the stain itself. Wipes are convenient, but are generally not as effective as other forms of stain removal treatments.

Thus, it is desirable to have methods and apparatus for improving the performance of spot-treatment products. It is also desirable to have methods and apparatus for removing stains without the requirement of a laundering step after a spot-treatment step.

SUMMARY OF THE INVENTION

While the manner in which the present invention addresses the disadvantages of the prior art will be discussed in greater detail below, in general, the present invention provides technology which offers significant advantages over prior art detergent delivery and targeted stain removal.

Further, as used herein, "detergent" is used to generally refer to laundry additives including detergents, boosters, bleaching agents, sanitizers, stain removing products, and the like, as well as other additives now known or as yet unknown to one skilled in the art. Use of the term "detergent" should not be construed as limited to the contemporary meaning of the word "detergent" to typical consumers.

In accordance with the present invention, a targeted stain removal system is provided which exhibits advantages over the prior art in terms of easy application to a targeted area and/or increased efficacy. In accordance with one embodiment of the present invention, a stain removal liquid is forced through a stained fabric by one of a variety of different methods. Preferably, when the stain removal liquid is forced through the fabric the stain is substantially removed, resulting in a substantially stain-free garment.

For example, in accordance with an exemplary embodiment of the present invention, the stain removal liquid is forced through a stained fabric by the application of a pressure (e.g., a vacuum or positive pressure) to the stained fabric. The stained fabric is placed over a reservoir containing the stain removal liquid. The pressure is applied to the fabric, which forces the stain removal liquid through the stained fabric, thereby removing the stain.

In accordance with an exemplary embodiment of the present invention, a hand-held apparatus is provided for facilitating the removal of a stain from a fabric. The apparatus contains a vacuum canister coupled to a nozzle (or vacuum port) on one side and coupled to a handle on the other side and a reservoir that is filled with stain removal liquid that is coupled to another nozzle on a second handle. A fabric is placed between the reservoir nozzle and the vacuum port. When the handles are squeezed together, the fabric is closer to both the reservoir and the nozzle. After the vacuum canister is activated, the vacuum generated lifts the stain removal liquid through the fabric and stain and through the vacuum nozzle, removing the stain from the fabric.

BRIEF DESCRIPTION OF THE DRAWINGS

A more complete understanding of the present invention may be derived by referring to the detailed description and claims when considered in connection with the figures, where like reference numbers refer to similar elements throughout the figures, and:

DETAILED DESCRIPTION

The following description is of exemplary embodiments of the invention only, and is not intended to limit the scope, applicability, or configuration of the invention in any way. Rather, the following description is intended to provide a convenient illustration for implementing various embodiments of the invention. As will become apparent, various changes may be made in the function and arrangement of the elements described in these embodiments without departing from the scope of the invention as set forth in the appended claims.

Figure 1:
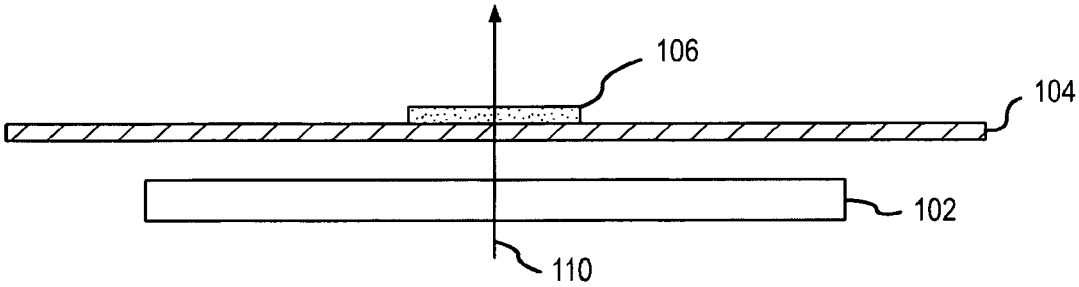
FIG. 1 illustrates a cross-section of the operation of an exemplary embodiment of the present invention.

Generally, an exemplary embodiment in accordance with the present invention (for example, such as illustrated in FIG. 1) comprises a reservoir containing a stain removal liquid 102 for removing a stain 106 from a fabric 104. Generally, fabric 104 may include a variety of types of fabric including cotton, polyester, wool, rayon, and various blends of fabrics, and the like. Likewise, fabric 104 may be part of a piece of clothing, curtain, drapes, tablecloths, rugs, or fabric in a variety of other forms.

Using an embodiment of the present invention, stain removal liquid 102 contained in the reservoir passes through fabric 104 and stain 106. For example, in accordance with various embodiments of the present invention, a stain removal system comprises a stain removal delivery device which includes a stain removal liquid, applied to a fabric using a stain removal liquid applicator. After being applied, stain removal liquid is removed from the fabric using a stain removal liquid extractor. In various embodiments stain removal (or assistance in stain removal) is accomplished via cooperation between stain removal liquid applicator and stain removal liquid in manner which causes the passage of stain removal liquid from a first side of the fabric to a second side of said fabric.

Figure 2:
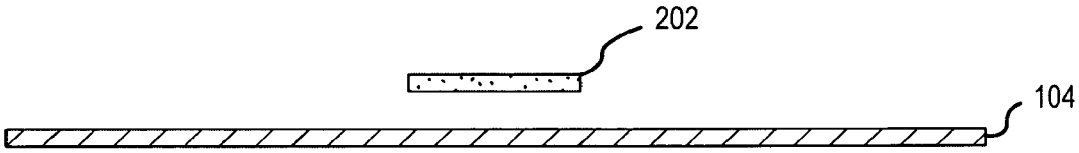
FIG. 2 illustrates a cross-section of a fabric after application of an exemplary embodiment of the present invention.

For example, in an exemplary embodiment such as illustrated in FIG. 2, as stain removal liquid 102 (stain remover) passes through fabric 104, stain 106 may be substantially carried with stain remover 102. As such, fabric 104 is substantially freed of stains. The material comprising the stain is now contained in a stain remover and stain mixture 202 along with the stain removal liquid, removed by action of the stain removal liquid passing through fabric 104.

It should be appreciated that the movement of the stain remover 102 through fabric 104 can be accomplished in a variety of different manners. For example, in accordance with various embodiments of the present invention, stain remover 102 is transported using a pressure. The pressure may be negative (a vacuum) and thus "draw" stain remover 102 through fabric 104 and stain 106. Alternatively, the pressure may be positive and thus "push" stain remover 102 through fabric 104 and stain 106. In still another embodiment, multiple "opposing" pressure may provided to move stain remover 102 through fabric 104 and stain 106. For example, a vacuum may placed on one side of fabric 104 and a positive pressure may be provided on the other, such that the opposing pressures both push and pull stain remover 102 through fabric 104.

Providing pressure (whether positive, negative or both) may be accomplished in a variety of manners, now known or as yet unknown in the art. For example, pressurizing devices such as air canisters, either positively pressurized or containing a vacuum, may be utilized in various embodiments of the present invention. Alternatively, other pressurization systems may be used. For example, separate systems using electrically powered (or otherwise) pumps, fans and/or tanks may likewise be substituted. Thus, it should be appreciated that numerous devices for providing pressure fall within the scope of the present invention.

Figure 3:
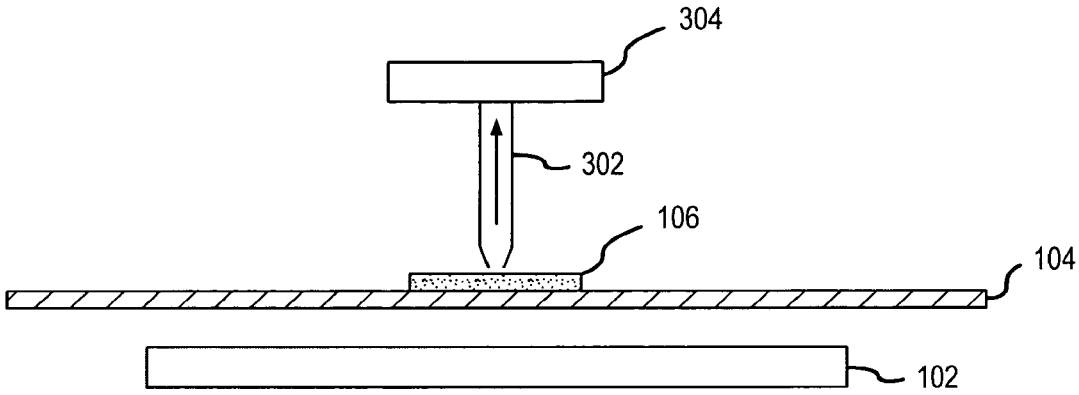
FIG. 3 illustrates a cross-section of an exemplary embodiment of the present invention.

For example, in one embodiment of the present invention, a vacuum source can be positioned such that stain remover 102 is "drawn" through fabric 104, removing stain 106. An embodiment exemplary of such is illustrated in FIG. 3. As noted above, a stain remover 102 is positioned on a side of fabric 104 opposite stain 106. Additionally, a vacuum port 302 is provided proximate to stain 106 on fabric 104. Vacuum port 302 is preferably coupled to a vacuum source 304. When vacuum source 304 is activated, stain remover 102 is drawn through fabric 104 and into vacuum 302. As mentioned above, as stain remover 102 passes through fabric 104, stain 106 is removed.

Figure 4:
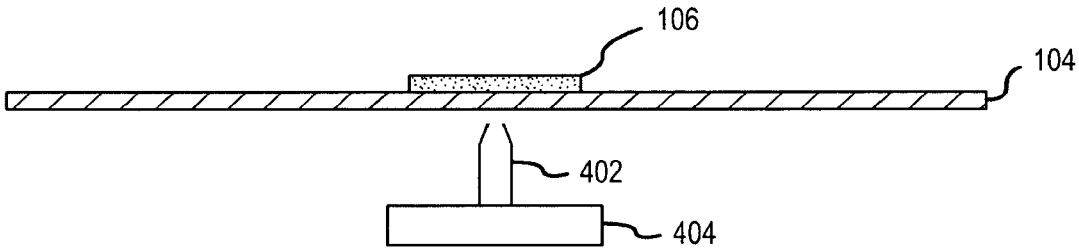
FIG. 4 illustrates a cross-section of another embodiment of the present invention.

Briefly, in accordance with an alternative aspect of the present invention, a positive pressure (as opposed to vacuum) may be used to transport stain remover 102. For example, such an embodiment is shown in FIG. 4. In this embodiment, stain remover 102, fabric 104 and stain 106 are again provided as above. Additionally, a pressure port 402 is coupled to an air source 404. Air source 404 also contains a stain removal liquid. When air source 404 is activated, stain removal liquid is forced through fabric 104, removing stain 106.

Likewise, as mentioned above, embodiments which combine the foregoing exemplary embodiments are also within the scope of the present invention. Stated otherwise, embodiments which both push and pull stain remover 102 through fabric 104 should be considered as in accordance with the present invention. Such embodiments may thus realize advantages corresponding to a complementary nature of the opposing pressures.

Stain removal liquid 102 can be combined with air source 404 in a variety of different manners. For example, stain removal liquid 102 may be included within a pressurized canister for providing air source 404. Alternatively, a hose can be used to couple stain removal liquid to pressure port (aka nozzle) 402 such that stain removal liquid 102 is sprayed through fabric 104, facilitating the removal of stain 106.

By drawing a stain removal liquid through a stained fabric, many benefits are realized. For example, there is no need to separately launder the fabric, as there is when a pre-treatment product of the prior art is used. As such there is no need for a drying period of the fabric, as only the stained area of the fabric is subjected to the stain removal liquid. In addition, the vacuum action of one of embodiments described above may also serve to at least partially dry the fabric.

In accordance with various embodiments of the present invention, stain removal liquid 102 may be any of numerous different types of liquids configured to remove stains. As such, stain removal liquid 102 may comprise any number of now known or as yet unknown laundry detergents or stain removing compositions. For example, stain removal liquid 102 may comprise various surfactant blends, solvents (aqueous or non-aqueous), water, enzymes, or bleaches.

For example, in this regard, stain removal liquid 102 may comprise any surfactant or surfactant blend that provides a cleaning benefit. For example, it will be appreciated that any suitable anionic, nonionic, ampholytic, zwitterionic, cationic or other surfactant or surfactant mixture may be used. Preferably, the surfactant or surfactant blend is formulated so as to exhibit a cleaning benefit for a variety of stains such as oily stains, waxy stains, sebum stains, protein stains, starchy stains, food stains, and particulate stains.

In another embodiment of the present invention, stain removal liquid 102 may comprise any suitable liquid that provides a cleansing benefit for oily, waxy, particulate or sebum stains. It is preferable that stain removal liquid 102 have a low volatility and have a molecular weight within the range of from about 100 to about 250. The solvent may be formed of any suitable glycolic, alcoholic or esteric, etheric hydrocarbon.

A stain remover in accordance with the present invention may also include a liquid carrier. In one embodiment, the liquid carrier comprises water, as water is a readily available, relatively inexpensive liquid carrier. In addition, water may facilitate the cleaning of water-soluble stains. However, other suitable liquid carriers may include propylene glycol, glycerin or other aforementioned glycol ethers or blends thereof.

In still another exemplary embodiment, the stain remover may comprise one or more enzymes that provide additional cleaning performance and/or fabric care benefits. Enzymes suitable for use in the stain remover of the present invention include proteases, cellulases, hemicellulases, peroxidases, gluco-amylases, lipases, cutinases, pectinases, xylanases, reductases, oxidases, phenoloxidases, lipoxygenases, ligninases, pullulanases, tannases, pentosanases, malanases, glucanases, arabinosidases, and/or other now known or hereafter devised enzymes and/or mixtures thereof.

Figure 5:
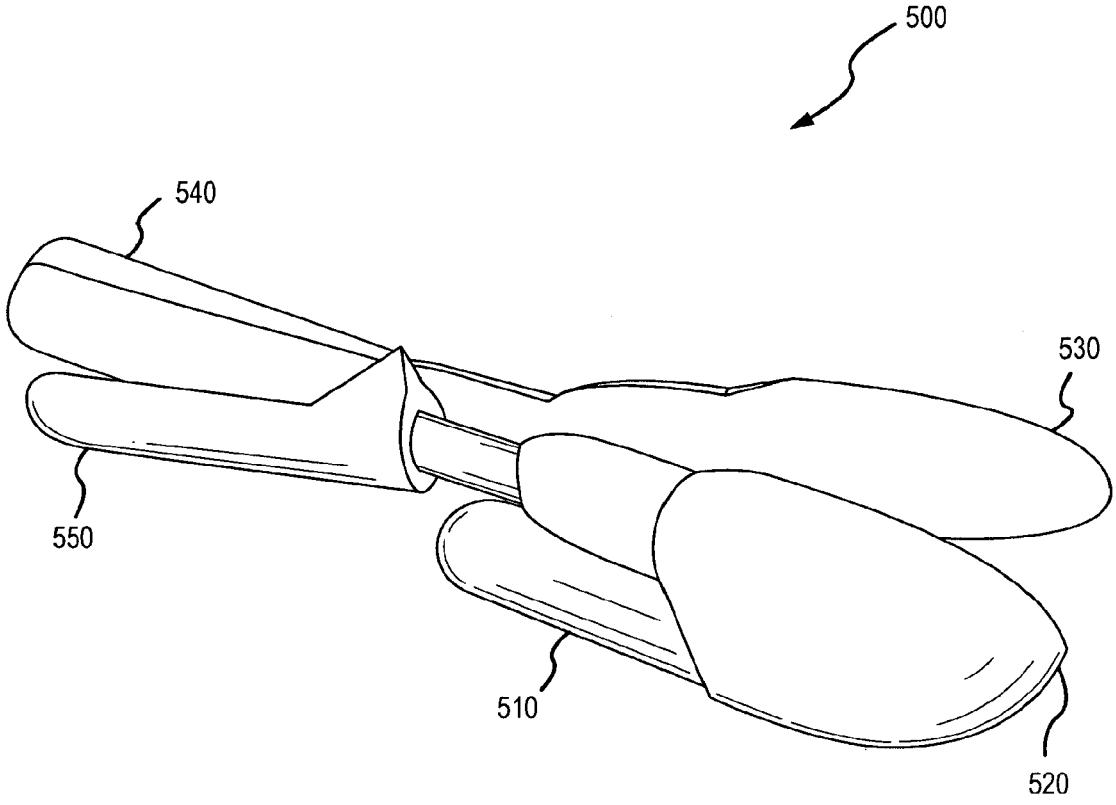
FIG. 5 is a perspective drawing of a hand-held apparatus in accordance with an exemplary embodiment of the present invention.

With reference now to FIG. 5, an exemplary embodiment in accordance with the present invention is further described. Apparatus 500 generally comprises a hand-held device that is used to remove stains from fabrics. In this embodiment, apparatus 500 comprises opposing handle members 540, 550, pivotably coupled to each other such that handle 540 can be squeezed together. Apparatus 500 further comprises first and second workpieces 520, 530 and positioned such that when handle 540 and handle 550 are squeezed together, workpiece 520 and workpiece 530 move closer to each other.

In this exemplary embodiment, workpiece 520 and workpiece 530 are configured such that fabric 104 is located between workpieces 520, 530 and maintained as substantially parallel between workpieces 520, 530. Additionally, in this embodiment, workpieces 520, 530 facilitate compression of fabric 104 between them and/or provide a substantially airtight seal. Of course, alternatively, workpieces 520, 530 may be configured in any number of sizes and shapes, but generally, preferably are configured with shapes that are substantially coincident with each other. For example, workpiece 520 may be convex and workpiece 530 concave such that workpiece 520 and 530 fit inside each other when handles 530 and 540 are pressed together. Suitably, vice versa, workpiece 520 may be concave and workpiece 530 convex.

In various embodiments, workpiece 520 is configured to accept a refill canister 510. Refill canister 510 is configured to provide stain remover 102 to apparatus 500. Preferably, refill canister 510 is configured such that a pre-determined amount of stain removal liquid is placed in the reservoir located in workpiece 520. In such a configuration, refill canister 510 has a valve that is configured to allow only the dispensing of a predetermined amount of stain removal liquid per use when apparatus 500 is activated.

Furthermore, in one embodiment, workpiece 530 is configured to be coupled to a vacuum source. In one embodiment, vacuum source comprises a vacuum canister (not shown) which is located in handle 540 and is configured to provide suction at workpiece 530 when apparatus 500 is activated. In such an embodiment a channel joins handle 540 and workpiece 530. Workpiece 530 is constructed such that the suction created by vacuum canister is directed to a predetermined area or workpiece 530. In one embodiment, a nozzle which ejects stain remover 102 is located at workpiece 530 such that, when handle 540 and handle 550 are squeezed together, the nozzle in workpiece 530 is opposite a vacuum port in workpiece 520 which receives stain remover 102. Upon activation of apparatus 500, stain remover 102 is ejected from nozzle, through fabric 104, dissolving and removing the stain, carrying the stain remover and stain mixture through vacuum port.

In accordance with further aspects of the present invention, apparatus 500 may further comprise additional features for improving performance and/or its utility. For example, in various embodiments, apparatus 500 comprises a filter (not shown) which assists in the prevention of stain 106 from dissipating back into fabric 104 after it has been removed by stain remover 102. For example, in an exemplary embodiment, filter comprises a one-way valve, such as those now known or as yet unknown in the art, between vacuum port and vacuum canister, whereby stain remover 102 and stain 106 mixture can leave fabric 104 and enter canister but prevents the mixture from leaving canister. Of course, in alternative embodiments, filter may be located in other areas on apparatus, such as for example, between vacuum port and fabric 104 itself.

In accordance with still further aspects of the present invention, apparatus 500 may further comprise one or more indicating features for displaying the status of apparatus 500 or its components. For example, exemplary status indicators include the remaining life of vacuum canister, the amount of stain remover 102 remaining in refill canister 510, or other numerous such properties.

Thus, in operating an exemplary embodiment of the present invention, a stained cloth (fabric 104) is placed between workpiece 520 and workpiece 530. The stained portion is placed over the vacuum port located in workpiece 520. Handles 540 and 550 are squeezed together, pressing workpiece 520 and workpiece against the stained cloth. The vacuum is activated (e.g., through activation of switch or other similar means for releasing pressure from the vacuum) and stain removal liquid 102 is forced from a reservoir located in workpiece 520 through the stained cloth into the vacuum canister. When the cloth will be slightly damp, if not removed from apparatus 500, the stain has been substantially removed. Furthermore, in various embodiments, the cloth will be slightly damp, if not substantially dry, as the suction action of the vacuum serves to perform a drying function to the cloth. Therefore, a stained cloth can be treated such that the stain can be removed without the need for a laundering step.

Finally, it should be noted that in the foregoing specification, the invention has been described with reference to non-limiting, exemplary embodiments. However, one of ordinary skill in the art appreciates that various modifications and changes can be made without departing from the scope of the present invention as set forth in the claims below. Accordingly, the specification is to be regarded in an illustrative rather than a restrictive sense, and all such modifications are intended to be included within the scope of the present invention.

I claim:

1. An apparatus for removing stains from fabrics comprising a first handle, said first handle containing a stain removal liquid and a first fabric area and a second handle coupled to said first handle, said second handle having a first pressure cartridge and a second fabric area.

2. The apparatus of claim 1, wherein said first handle further comprises a stain removal liquid exit port.

3. The apparatus of claim 1, wherein said first handle further comprises a pressure port.

4. The apparatus of claim 1, wherein said first pressure cartridge contains a positive pressure.

5. The apparatus of claim 1, wherein said first pressure cartridge contains a vacuum.

6. An apparatus for removing stains from fabrics comprising:

a first handle configured to accept a stain removal liquid;

a second handle pivotally coupled to said first handle and configured to provide a pressure, wherein said provided pressure is a negative pressure;

a first workpiece coupled to said first handle and having a stain removal liquid exit port; and a second workpiece coupled to said second handle and having a stain removal liquid intake port.

7. The apparatus of claim 6, wherein when said first and second handles are compressed, said first and second workpieces are directed proximate to one another.

8. The apparatus of claim 7, wherein when said first and second workpieces are proximate to one another, said stain removal liquid exit port is proximate to said stain removal liquid intake port.

* * * * *